US006099115A

United States Patent [19]

Faoro

[11] Patent Number: 6,099,115

[45] Date of Patent: Aug. 8, 2000

[54] INK RESERVOIR FOR AN INK JET PRINTER OR PLOTTER

[75] Inventor: Francisco Faoro, Zurich, Switzerland

[73] Assignee: Pelikan Produktions AG, Switzerland

[21] Appl. No.: 09/039,799

[22] Filed: Mar. 16, 1998

[30] Foreign Application Priority Data

Mar. 17, 1997 [DE] Germany ..... 197 10 969

[51] Int. Cl.[7] ..... B41J 2/175

[52] U.S. Cl. ..... 347/86

[58] Field of Search ..... 347/36, 49, 85, 347/86, 87

[56] References Cited

U.S. PATENT DOCUMENTS

| | | | |
|---|---|---|---|
| 4,695,824 | 9/1987 | Tazaki | 347/86 |
| 4,901,094 | 2/1990 | Iwagami et al. | 347/36 |
| 5,157,421 | 10/1992 | Kitahara | 347/86 |
| 5,365,262 | 11/1994 | Hattori et al. | 347/87 |
| 5,400,066 | 3/1995 | Matsumoto et al. | 347/86 |
| 5,519,422 | 5/1996 | Thoman et al. | 347/49 |

FOREIGN PATENT DOCUMENTS

| | | |
|---|---|---|
| 0606047 A2 | 12/1993 | European Pat. Off. . |
| 2831973 A1 | 1/1980 | Germany . |
| 3645048 C2 | 3/1992 | Germany . |
| 9306729 U1 | 8/1993 | Germany . |
| 3316969 C2 | 4/1994 | Germany . |

*Primary Examiner*—N. Le
*Assistant Examiner*—Anh T. N. Vo
*Attorney, Agent, or Firm*—Faye, Sharpe, Fagan, Minnich & McKee, LLP

[57] ABSTRACT

The ink reservoir comprises a bottle (1) into which is installed a foil bag (2). The bag (2) is designed at both axial ends as a standing bag. In one end of the bag (2) includes a thermoplastic connector (23) having an elastomer stopper (27) disposed therein. The stopper is piercable by a first hollow needle of the plotter. The connector (23) is snapped into a lid (4) of bottle (2) below a passage opening (44). The lid (4) is snapped onto the bottle (1). Below the lid (4), an absorbent body (3) is installed in the bottle (1) which surrounds the bag. By means of another opening (45) in lid (4) a second hollow needle of the plotter is inserted into the absorbent body (3). The absorbent body serves for acceptance of waste ink. With the described design, one attains simple handling during shipping and installation in the plotter.

12 Claims, 1 Drawing Sheet

FIG. 1
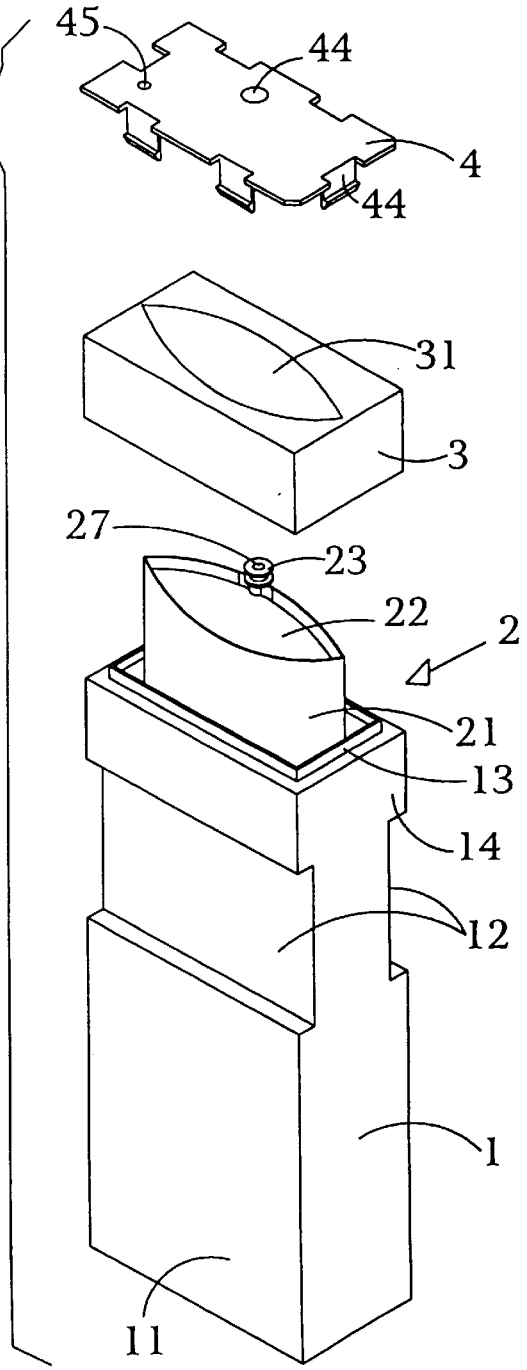
FIG. 2
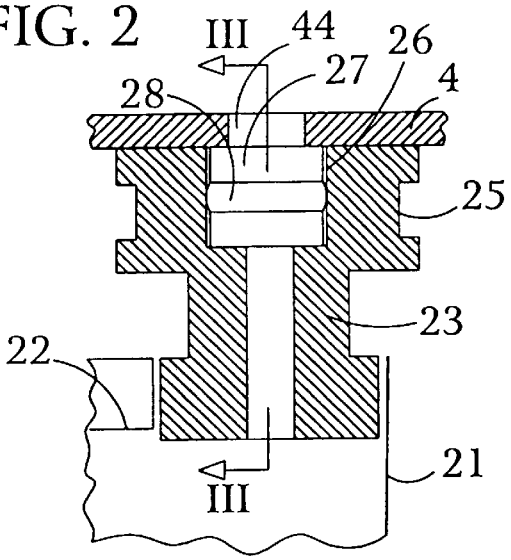
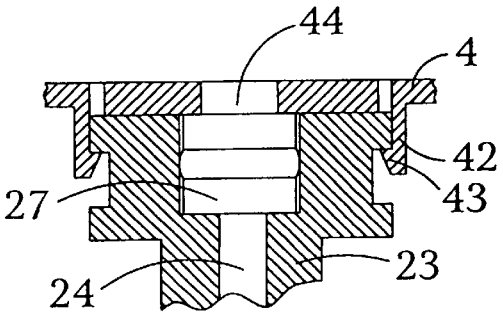
FIG. 3

INK RESERVOIR FOR AN INK JET PRINTER OR PLOTTER

BACKGROUND OF THE INVENTION

The present invention relates to the art of ink system supply systems for ink jet printers and plotters. It finds particular application in conjunction with a replaceable ink reservoir and will be described with particular reference thereto.

An ink reservoir is known from EP-A-606047. One of the there indicated specific embodiments comprises a bag of thermoplastic foil, which has at one end an elastomer stopper for insertion of a hollow needle of a connecting hose to a plotter.

SUMMARY OF THE INVENTION

In accordance with the present invention, a new and improved ink reservoir is provided. The ink reservoir includes an outer reservoir containing an ink bag. The ink bag has, at one end, a stopper inserted therein which is piercable by a first hollow needle of a printing device. The connector is connected with a lid of the reservoir and is accessible through a first opening through the lid. An absorbent body is installed in the reservoir for accepting waste ink. The lid has a second opening which receives a second hollow needle from the printing device. The absorbent body is configured for the insertion of the second hollow needle to directly receive waste ink, and the lid is unremovably joined to the reservoir.

In accordance with a more limited aspect of the present invention, the absorbent body surrounds the ink bag.

The present invention is based on the object of simplifying the handling of such ink reservoirs. The object is solved by the combined features of the present of claims.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein:

FIG. 1 is a perspective view of an ink reservoir in accordance with the present invention;

FIG. 2 is a cross-section through the connector of the ink reservoir shown in FIG. 1;

FIG. 3 is a section along line III—III in FIG. 2.

DETAILED DESCRIPTION OF THE PREFERRED EMBODIMENT

With reference to FIG. 1, an ink reservoir includes a bottle or housing 1, an ink bag 2, an absorbent body 3, and a lid 4.

Bottle 1 is a blown, quadrangular, thin-walled bottle, for example of polyester. It has two side walls 11 which include two constrictions 12 for installation in the plotter and on a top surface, includes a constricted edge 13 for snapping on lid 4. Bag 2 is designed on both axial ends as a standing bag. For that purpose, a convex-curved inlay 22 is formed at both the top end and at the bottom end into the two side walls 21. The bag 2 is formed, for example, from a thermoplastic foil.

With reference to FIGS. 1–3, between the one side wall 21 and the upper inlay 22, there is a thermoplastic, pipe-shaped connector 23. The connector 23 has a stepped-down passage bore 24 and adjacent the top, it includes a circumferential groove 25 along an outer periphery. Into the upper, cylindrical segment 26 of bore 24 is pressed, by way of sealing function, an elastomer, cylindrical stopper 27 of NBR, with a circumferential bulge or sealing surface 28. The stopper 27 is pierced by a hollow needle mounted in the printer or plotter when the ink reservoir is connected to the printer or plotter. This establishes fluid communication therebetween.

The absorbent body 3 is formed, for example, of cellulose or of absorbent foam material and is fitted in space 14 between the constriction 12 and edge 13 such that it is maintained adjacent the lid 4. The body 3 has an axial passage opening 31 generally matching the outer contour of bag 2 such that the bag 2 is received therein and the body 3 is disposed surrounding the bag 2. Lid 4 is snapped onto edge 13 with snap elements 41. With reference to FIGS. 2 and 3, the lid 4 has two opposed, resilient tongues 42 with hooks 43, which are snapped, prior to installation of lid 4, into groove 25. Between the tongues 42, lid 4 has a passage opening 44, which is co-axial vis-a-vis the bore segment 26.

With reference to FIG. 1, in proximity to one corner, lid 4 has another passage bore 45 or a thin spot for piercing by a second hollow needle of the plotter. The hollow needle is inserted into the foam body when the reservoir is installed in the plotter. The foam body 3 accepts waste ink which is generated during rinsing of the print head jets.

Simple handling during transport and during installation into the plotter is obtained by means of the described design of the reservoir. Since with each newly installed reservoir there is concurrently installed a fresh, unused absorbent body 3, there is automatic assurance for the capacity of accepting waste ink. No separate holding tank for waste ink is needed, the filling degree of which would have to be monitored. The ambi-lateral design of bag 2 as a standing bag results in high holding capacity, i.e., optimal utilization of space.

The reservoir can have mechanical coding means, so that it can only be installed in the correct position and in the correct place. For that purpose, for example, the constrictions 12 on the two sides can have different depths or different widths, or the basic form of lid 4 can have an asymmetrical shape.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. An ink reservoir for use with an associated ink jet printing device, the ink reservoir comprising:

a housing;

an ink dispensing bag disposed within the housing, the ink dispensing bag including a connector member defining a fluid path into the ink dispensing bag and being sealed by a stopper, the ink dispensing bag formed of a double concave parallel wall structure defining opposite axial ends, each of said opposite axial ends including a double convex inlay;

a fluid absorbing member disposed within the housing and surrounding the ink dispensing bag; and a lid for closing the housing and including a first opening being aligned with the connector member such that a first hollow needle from the associated printing device selectively pierces the stopper to establish fluid communication between the ink dispensing bag and the associated printing device upon installation of the ink reservoir onto the associated printing device, and a second opening adapted to receive a second hollow needle from the associated printing device which transmits waste ink, the second hollow needle selectively engaging the fluid absorbing member.

2. The ink reservoir as set forth in claim 1, wherein:

the fluid absorbing member defines a double concave parallel wall axial opening; and, at least a portion of the ink dispensing bag is disposed within said double concave parallel wall axial opening.

3. An ink reservoir apparatus for use with an associated ink jet printing device, the ink reservoir apparatus comprising:

an outer substantially rigid ink reservoir member;

a lid selectively connected onto said ink reservoir member, the lid defining a first opening and a second opening and carrying a plurality of snap elements engageable with said ink reservoir member for rendering the lid unremovable when the lid is connected to the ink reservoir member;

a foil ink dispensing bag disposed in said ink reservoir member, the bag being formed having a double concave parallel wall structure defining opposite axial ends, the bag including a double convex inlay on each said axial end;

a connector member carried on a first end of the ink dispensing bag, the connector member being welded between a first double convex inlay and a first concave wall structure of the ink dispensing bag, said connector member being selectively connectable with said lid of the ink reservoir member and being selectively accessible through said first opening formed in said lid;

a resilient stopper member carried by the connector member, the stopper member being adapted to receive a first needle from the associated ink jet printing device extending through said first opening formed in the lid; and, an absorbent body disposed in said ink reservoir adjacent said second opening formed in the lid and adapted to accept waste ink from a second needle of the associated printing device extending through said second opening.

4. The ink reservoir apparatus according to claim 3 wherein the lid is snapped onto a main body of said ink reservoir member.

5. The ink reservoir apparatus according to claim 3 wherein the ink reservoir member is a blown bottle of thermoplastic material, including polyester.

6. The ink reservoir apparatus according to claim 3 further including mechanical coding means to assure correct insertion of the ink reservoir member into the associated printing device.

7. The ink reservoir apparatus according to claim 3 wherein the absorbent body is formed of a one of a cellulose material and a foam material.

8. The ink reservoir apparatus according to claim 3 wherein the ink reservoir member includes a constriction for holding the absorbent body adjacent the lid.

9. The ink reservoir apparatus according to claim 3 wherein the stopper is formed of an elastomer including acrylnitrile-butadiene rubber and is installed in a bore of the connector member.

10. The ink reservoir apparatus according to claim 9, wherein the connector member is snapped into the lid.

11. The ink reservoir apparatus according to claim 3 wherein the absorbent body surrounds the ink dispensing bag.

12. The ink reservoir apparatus according to claim 11, wherein the absorbent body includes a central opening, the ink dispensing bag being disposed within the central opening.

* * * * *